United States Patent [19]

Lile et al.

[11] 4,436,272

[45] Mar. 13, 1984

[54] CHRISTMAS TREE STAND HAVING STABILIZED CLAMPING MEMBERS

[76] Inventors: James B. Lile, Rte. 1, Russellville, Ark. 72801; Dan C. Mathes, Jr., 301 Ridgeway, Little Rock, Ark. 72205

[21] Appl. No.: 364,791

[22] Filed: Apr. 2, 1982

[51] Int. Cl.[3] ..... A47G 33/12

[52] U.S. Cl. ..... 248/527

[58] Field of Search ..... 248/519, 523, 524, 525, 248/526, 527, 528, 529, 231.4, 316 A; 269/47, 152, 902, 287, 261, 279, 280, 283

[56] References Cited

U.S. PATENT DOCUMENTS

| | | | |
|---|---|---|---|
| 575,909 | 1/1897 | Schuler | 269/152 |
| 831,629 | 9/1906 | Rollman | 248/231.4 |
| 958,644 | 5/1910 | Huff | 248/523 |
| 1,137,109 | 4/1915 | Arneson | 269/279 |
| 1,540,856 | 6/1925 | Munro | 248/523 |
| 1,873,693 | 8/1932 | Whitfield | 248/524 |
| 2,764,047 | 9/1956 | Allbritton | 269/283 |
| 3,329,380 | 7/1967 | Graves | 248/527 |
| 3,767,183 | 10/1973 | Van Gelder | 269/283 |
| 4,019,726 | 4/1977 | Turner | 269/261 |
| 4,369,957 | 1/1983 | Williams | 269/902 |

*Primary Examiner*—William H. Schultz
*Assistant Examiner*—Robert A. Olson
*Attorney, Agent, or Firm*—Jerome A. Gross

[57] ABSTRACT

A stand including a square vessel in which the trunk of a Christmas tree is clamped and held, has a pair of clamping screws extending inward from its opposite corners, along a common diagonal axis. The inner ends of the clamping screws have narrowed necks over which fit slotted clamping angles, whose bottom ends are slotted upwardly to fit onto a diagonal rib in vertical registration with the clamping screw axis. As the screws are advanced inwardly the clamping angles are guided and stabilized by the rib, to maintain parallelism with the square corners of the vessel.

6 Claims, 4 Drawing Figures

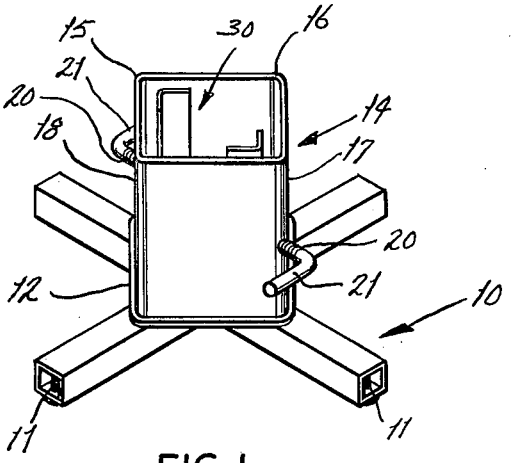
FIG. 1
FIG. 4
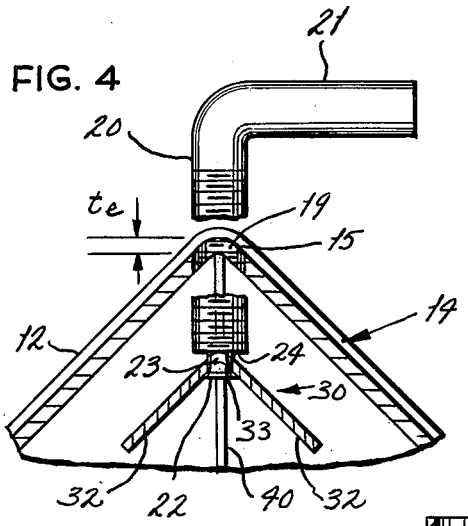
FIG. 2
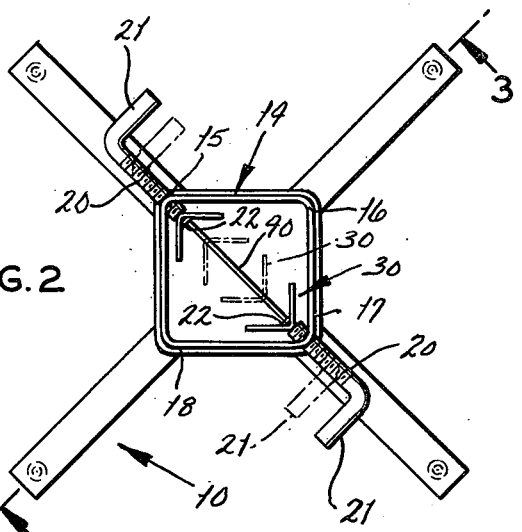
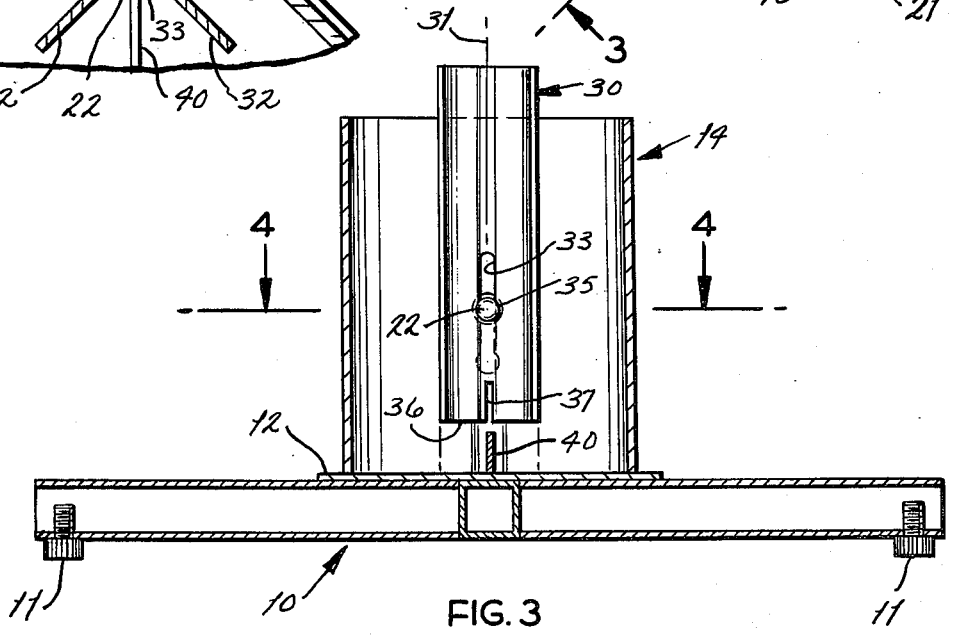
FIG. 3

CHRISTMAS TREE STAND HAVING STABILIZED CLAMPING MEMBERS

TECHNICAL FIELD

This invention refers to stands or holders in which the bottom ends of the trunks of Christmas trees and the like are clamped for support.

BACKGROUND ART

It is familiar to hold Christmas trees in vessel-like stands by clamping the lower ends of the trunks, using one or more inward projecting clamping screws. For example, in U.S. Pat. No. 2,913,202, to Meldrum, three clamping screws, each mounted through a nut welded onto the outer surface of the vessel, have inner ends which bear against clamping plates hinged at one side to the inner wall of the vessel. In U.S. Pat. No. 3,885,763 to Gidlof, a single clamping screw projects through the wall of the circular vessel, for screwing through a nut mounted between separator strips within the vessel; on the inner end of the screw is mounted the apex of a clamping angle which moves inward to clamp the tree trunk against a fixed clamping angle member. It is believed that there are many other variations in the use of clamping screws to hold tree trunks and the like.

DISCLOSURE OF THE INVENTION

The present invention differs markedly from these prior constructions in the features set out and claimed herein. Among the more valuable of these improved features are use of a square vessel whose opposite right angle bends are drilled and tapped on a common diagonal axis. It is found that the effective thickness of the vessel wall for threading is substantially increased by threading through the bends of the material, rather than through flat portions. This greater effective thickness for threading stabilizes a pair of clamping screws whose inner ends mount clamping angle; these are maintained substantially parallel to the right angle bends of the vessel regardless the extent to which the clamping screws are advanced into the vessel. Preferably a diagonal rib, in vertical registration with the clamping screw axis, extends across the horizontal bottom wall of the vessel; and the clamping angles have lower end slots to fit over and slide along the rib as the clamping screws are advanced into the vessel. Assembly is facilitated by providing the screws with narrowed neck portions spacedly adjacent to the inner ends of the clamping screw and midlevel slots in the clamping angle members, the bottom ends of the slots being enlarged roundedly to fit over the inner ends of the screws, the slot widths thereabove being sufficient to pass downwardly over the neck portions of the screws. The clamping angles are mounted by lowering them into the vessel until the clamping screw ends may pass through the enlarged rounded lower ends of the midlevel slots, and the continuing to lower their midlevel slots downward over the screw neck portions as the lower end slots slide downward to fit guidedly onto the upward projecting bottom rib.

THE DRAWINGS

FIG. 1 is a perspective view of a Christmas tree stand embodying the present invention, as seen partly from above.

FIG. 2 is a plan view of the article of FIG. 1. The phantom lines show the position of the clamps when advanced inwardly.

FIG. 3 is a sectional view taken along line 3—3 of FIG. 2 showing one of the clamping angles being assembled onto the head of the clamping screws prior to lowering in place. Its lowered position is shown in phantom lines.

FIG. 4 is an enlarged fragmentary sectional view taken along line 4—4 of FIG. 3, showing a clamping angle after being lowered in place, with the clamping screw broken away to illustrate the effective thickness of the threads in which the clamping screw is received.

BEST MODE FOR CARRYING OUT THE INVENTION

The embodiment illustrated in the drawings is the best mode contemplated by the inventor for carrying out the present invention. The illustrated embodiment includes a conventional X-shaped base generally designated 10, preferably formed of welded steel tubing, whose members are arranged at 90° to each other in a plane. Leveling feet are provided at the extremeties of each leg. Welded at the intersection of the frame 10 is a rectangular steel base plate 12, which serves as the bottom of a vessel to be described.

Welded on the base plate 12 is a continuous vertical wall generally designated 14 which is divided by four substantially right angular bends 15, 16, 17 and 18, to provide the substantially square shape seen in the drawings. At about mid-height of the vessel so formed, two of the bends 15, 17, which are diagonally opposite each other, have along a diagonal, horizontal axis, drilled and tapped bores 19, one of which is seen in FIG. 4, to receive clamping screws 20 having bent handle portions 21. Such tapped bores 19, best seen in FIG. 4, include threaded portions which, because of the bend 15 of the material, support the clamping screws 20 over an effective thickness of $t_e$, roughly twice as great as the actual thickness of the vertical wall 14.

At its inner end, each of the clamping screws 20 has a flat-tipped, inward tapered head 22, which is smaller in diameter than the outer diameter of the threaded portion of the screw 20. The taper is preferably at an angle of 45° and leads inward to a smaller diameter neck portion 23 terminating in an annular shoulder 24 which extends to the outer threaded diameter of the screw 20.

Mountable on the neck portion 23 of each of the clamping screws 20 is a clamping angle generally designated 30, whose height is substantially equal that of the vessel wall 14. The clamping angles 30 are formed to a right angle bend, as best seen in FIG. 4, thus providing a vertical apex or bend line 31, as seen in FIG. 3, which divides such angle 30 into two right angle flange portions 32. Along the apex line 31 at about the mid-height of each clamping member 30 is formed a vertical midlevel slot 33, whose width is slightly greater than that of the neck portion 23 of the clamping screws 20 but smaller than the diameter of their tapered heads 22. As best seen in FIG. 4, the length of the neck portion 23 is such that, when a clamp angle 30 is mounted in position with portions of its outward presented surface along its apex line 31 against the shoulder 24 of a clamping screw 20, portions of the 45° tapered surface of the head 22 will bear with clearance against the inward presented surfaces of the right angle flange portions 32 of the clamp angle 30. Thus, as the tapered surface of the screw head 22 bears against two portions of the forward surface of the clamp angle 30 at the level of the axis of the screw, the screw shoulder 24 bears against the outer surface of the angle, along its apex line, on portions above and below the screw axis. Together these bearing points afford sufficiently firm support for the clamp angle 30.

Each of the mid-level slots 33 extends downward to an enlarged rounded lower end 35, whose diameter is greater than that of the clamping screw heads 22. The height of the upper end of each slot 33 above the lower end of the clamping angle 30 corresponds substantially to the height of the vessel wall bores 19 above the base plate 12.

Extending upward into the lower end 36 of each of the clamping angles 30, to an extent about equal to that of the narrowed portion of the mid-level slots 33, is a lower end slot 37. Its width is sufficiently great to slide along a diagonal rib 40 seen in FIGS. 2, 3 and 4, welded across the upper surface of the base plate 12 between the corners 15, 17.

In order to assemble the present Christmas tree stand, the clamping screws 20 are screwed into the threaded bores 19 to the solid line position shown in FIGS. 1 and 2. Each of the clamping angles is then mounted by lowering it within the vessel wall 14 until the enlarged lower end 35 of its midlevel slot 33 may pass over the tapered head 22 at the inner end of a clamp screw 20, that is, to the level shown in solid lines in FIG. 3. Then, by pressing the clamping angle toward the respective corner 15, 17 of the vessel, the head 22 is brought through the midlevel slot 33 until the latter is in registration with the screw neck portion 23. The angle 30 is then lowered downward until its lower end slot 37 may pass over the horizontal bottom rib 40 and the clamp angle lower end 36 rests on the base plate 12.

To clamp a tree within the stand, its trunk is inserted between the clamping angles 30 and the screws 21 are advanced inward substantially equal distances to clamping positions which may approach those shown in phantom lines in FIG. 2. As the clamping screws 20 are turned, portions of the annular wall of the shoulder 24 will bear and rub against the outward presented surface of the clamp angle 30 along apex line 31 above and below the screw axis; whereas, portions of the 45° tapered surface of the head 50 may bear and rub against the inward presented surfaces of the flange portions 32 at about the screw centerline. In absence of a stabilizing force, these rubbing forces would tend to rotate the clamping angles 30 on the neck portions 23 of the clamping screws 20. However, any such tendency to rotate is overcome by the resistance afforded by the upstanding rib 40 on the bottom wall 12, which serves to stabilize the clamping angles 30 as they are advanced and retracted, holding them substantially parallel to the corner angular portions 15, 17 of the vessel 14.

From this disclosure, modifications will occur to persons familiar with the prior art.

The embodiments of the invention in which an exclusive property or privilege is claimed are defined as follows:

1. A clamping stand for Christmas trees and the like, comprising a vessel having a continuous vertical wall, whereby the bottom of the trunk of such tree may be received therein, base means secured thereunder, a pair of horizontal clamping screws threaded through the vertical wall of the vessel and presented opposite to each other, and a vertical clamping member mounted on the inner end of each clamping screw, characterized in that each clamping screw has, spaced from its inner end, a reduced diameter neck portion terminating outwardly in a shoulder, further characterized in that each vertical clamping member has, substantially along its mid-height, a vertical slot including a rounded lower end portion sufficiently large to pass over the inner end of a clamping screw and a narrower slot portion extending upwardly therefrom, said narrower portion being sufficiently wide to engage slidingly on the neck portion of the clamping screw but smaller than the shoulder thereof, whereby on so screwing a screw inner end through the vessel wall as to project inwardly into the vessel, the clamping member may be mounted thereon by passing the lower end of said mid-level slot over the clamping screw inner end and sliding the said slot downward along the neck portion, and whereby clamping may thereafter be achieved by pressure of the shoulder against the clamping member.

2. A Christmas tree stand as defined by claim 1, in which the vessel is of substantially square cross-section and its wall has four substantially right angle bends, and said clamping screws are threaded through bores in two of said bends opposite each other along a diagonal horizontal axis, and in which the clamping members are bent right angular members, whereby to be presented substantially parallel to corner angles of the vessel regardless of the extent said clamping screws are advanced into the vessel.

3. A Christmas tree stand as defined in claim 2, wherein the vessel has a substantially horizontal bottom wall and a horizontal rib extending diagonally across the upper surface of said wall in vertical registration with said diagonal axis, and each of said right angular clamping members has a lower end slot extending upward along its bend to a height substantially equal to the depth of said rib, whereby on assembling the clamping members by their mid-level slots onto the neck portions of the clamping screws and so sliding them downward, the lower end slots of said clamping members will fit over said rib and be guided thereby as the clamping screws are advanced into the vessel.

4. A Christmas tree stand as defined in claim 3, wherein the length of the lower end slots of clamping members is substantially equal to the length of the narrower portion of the mid-level slots.

5. A clamping stand as defined in claim 1, further characterized in that the clamping members have a vertical apex line from which angle flange portions extend at right angles, and at the inward boundary of each clamp screw neck portion is a 45° tapered head, whereby portions of the tapered surface of the head bear with clearance against the inward presented surfaces of the clamping angle flange portions as portions of the shoulder of the clamp screw bear against the outward-presented surface of the clamping member along its apex line, thereby supporting the clamping member.

6. A clamping stand as defined in claim 5, further characterized in that the vessel has, at the level of its bottom, an upwardly presented horizontal rib in vertical registration with said opposite horizontal clamping screws, and each of said clamping members has a lower end slot extending upward along its apex line, said slot being of such width as to fit slidably over and along said rib, whereby the clamping members will be stabilized against rotation as the clamping screws are adjusted.

* * * * *

UNITED STATES PATENT AND TRADEMARK OFFICE

CERTIFICATE OF CORRECTION

PATENT NO. : 4,436,272

DATED : March 13, 1984

INVENTOR(S) : James B. Lile, Dan C. Mathes, Jr.

It is certified that error appears in the above-identified patent and that said Letters Patent is hereby corrected as shown below:

Col. 1, line 60, "the" should be deleted and ---then--- inserted.

Signed and Sealed this

*Nineteenth* Day of *June 1984*

[SEAL]

*Attest:*

GERALD J. MOSSINGHOFF

*Attesting Officer*

*Commissioner of Patents and Trademarks*